United States Patent [19]

Trotter

[11] 4,061,125

[45] Dec. 6, 1977

[54] BOWSTRING POSITIONING DEVICE

[76] Inventor: George H. Trotter, 7107 Janey St., Shreveport, La. 71108

[21] Appl. No.: 635,865

[22] Filed: Nov. 28, 1975

[51] Int. Cl.[2] ..... F41B 5/00

[52] U.S. Cl. ..... 124/24 R; 124/88

[58] Field of Search ..... 124/23 R, 24 R, 90, 124/86, 88, 89, 25, 35 A, 23, 24, 35

[56] References Cited

U.S. PATENT DOCUMENTS

| | | | |
|---|---|---|---|
| 1,375,990 | 4/1921 | Yorgensen | 124/25 |
| 2,815,016 | 12/1957 | Kellogg | 124/35 A |
| 2,921,572 | 1/1960 | Miller et al. | 124/90 X |
| 3,446,200 | 5/1969 | Gross | 124/24 R |
| 3,483,857 | 12/1969 | Jones | 124/25 |
| 3,561,418 | 2/1971 | Fredrickson | 124/24 R |
| 3,804,072 | 4/1974 | Izuta | 124/24 R |

*Primary Examiner*—Richard C. Pinkham
*Assistant Examiner*—William R. Browne
*Attorney, Agent, or Firm*—John M. Harrison

[57] ABSTRACT

A bowstring positioning device for preventing movement of a bowstring into a normal straight line position between the ends of a bow, which consists of a shaft, one end of which is mounted on the bow and the other end having an enlarged, padded projection to receive the bowstring.

7 Claims, 4 Drawing Figures

BOWSTRING POSITIONING DEVICE

BACKGROUND OF THE INVENTION

1. Field of the Invention

This invention relates to a new and improved device for effecting deflection of a bowstring from a normal straight line position between the ends of the bow. The bowstring positioning device of this invention minimizes bowstring "whip" or misalignment due to small irregularities in the manufacture of the carrying bow, which misalignment causes an increasing error in arrow trajectory accuracy as the bowstring approaches the bow when the arrow is released. The device also facilitates release of each arrow from the bowstring at precisely the same point with respect to the bow and permits a greater energy supply to be imparted to each arrow released.

2. Description of the Prior Art

Heretofore, bows have been manufactured in conventional fashion with bowstrings describing a straight line between points of attachment at each end of the bow. Thus, the length of draw for each sucb bow varies and the accuracy of the arrow trajectory for each respective bow depends in large measure upon the accuracy and uniformity of the bow itself. U.S. Pat. No. 3,527,195 to Martin L. Corio discloses the use of a pair of stabilizers with a slingshot device, which stabilizers are designed to reduct string quiver and limit the forward movement of the string in an attempt to improve accuracy. The stabilizers are mounted either on the frame of the device or on either side of the handgrip, and do not deflect the string from its normal straight line position between the ends of the frame.

It has been found that conventional bows are only as accurate as manufacturing techniques will permit uniformity to be built into such bows in large scale production. This is true because as an arrow is released in a selected bow, the bowstring approaches the bow rapidly, driving the arrow before it. Any defects in the bow manufacture which cause uneven distribution of forces on the bowstring, and hence the arrow, will cause the arrow to deflect from the target to that degree, and the magnitude of the error increases as the bowstring approaches the bow.

Accordingly, it is an object of this invention to provide a new and useful bowstring positioning device for use in cooperation with conventional and compound bows to cause the bowstring to stop short of a normal, straightline position between the ends of the bow when an arrow is released from the bow.

It is another object of this invention to provide a bowstring positioning device which will operate on conventional and compound bows which are preferably fitted with slightly longer bowstrings than is customary, to produce a higher energy in the released arrow than is possible in the same bow not equipped with the device.

Yet another object of the invention is to provide a new bowstring positioning device which reduces the length of draw of a bow while at the same time increases the potential energy of the string before release, and the kinetic energy of the released arrow.

A still further object of the invention is to provide a bowstring positioning device which catches the released bowstring at a constant, predetermined point and distance from the bow, thereby insuring a quick, clean release between the bowstring and arrow notch.

A further object of the invention is to provide a bowstring positioning device which serves as an arm guard to prevent the bowstring from striking the user's arm after release of an arrow.

SUMMARY OF THE INVENTION

These and other objects of the invention are provided in a bowstring positioning device which includes a shaft of predetermined length and having a padded projection on one end thereof to receive a bowstring after release of an arrow. The opposite end of the shaft is mounted on the bow, typically under the handgrip.

BRIEF DESCRIPTION OF THE DRAWINGS

The invention will be better understood in view of the following description presented with reference to the accompanying drawing.

DESCRIPTION OF THE PREFERRED EMBODIMENTS turn attached

Figure 1:
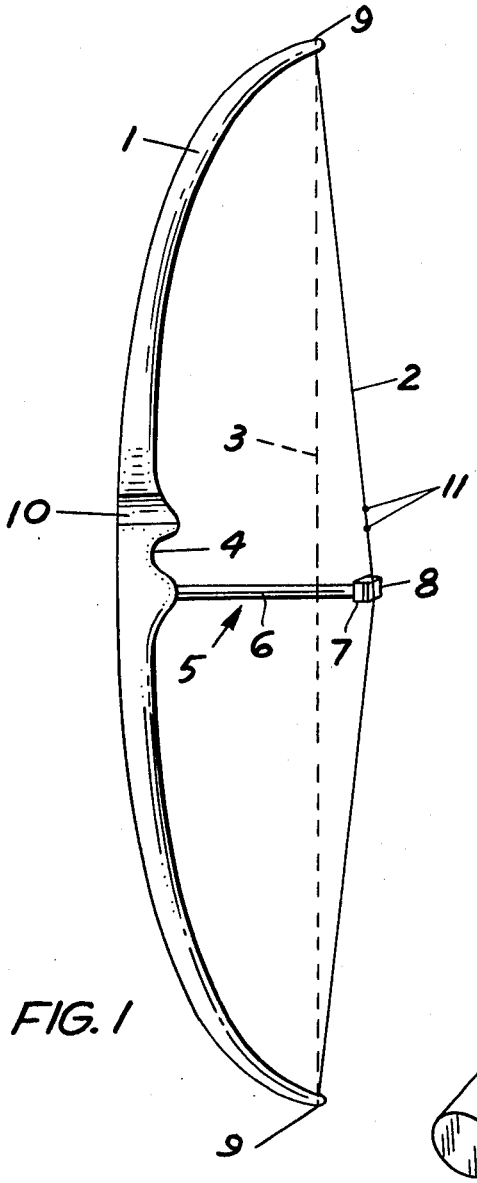
FIG. 1 is a perspective view of a conventional bow equipped with the bowstring positioning device of this invention.

Referring now to FIG. 1 of the drawing, bow 1 is equipped with bowstring 2 positioned on bowstring mounts 9 out of the usual straight line bowstring position 3, across bowstring block pad 8 of bowstring positioning device 5. It will be appreciated for reasons hereinafter set forth that bowstring 2 is somewhat longer than the straight line bowstring position 3. Bowstring positioning block 7 carries bowstring block pad 8 and is in turn attachd to bowstring positioning shaft 6. Bowstring positioning shaft 6 is attached to bow 1 at any convenient point, but preferably below handgrip 4, as illustrated. Bow arrow rest 10 is provided in bow 1 and arrow notch markers 11 are also positioned on bowstring 2 in alignment with bow arrow rest 10.

Figure 2:
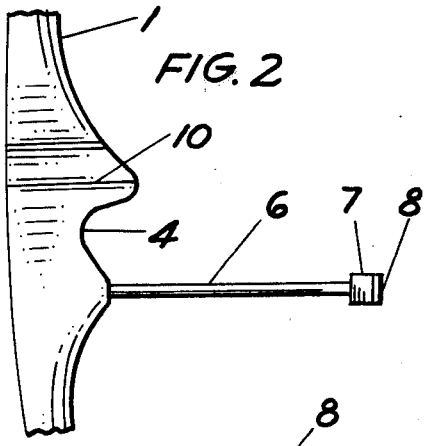
FIG. 2 is a side elevation, partially in section, of the bow illustrated in FIG. 1, more particularly illustrating a preferred mount for the bowstring positioning device.

As illustrated in FIGS. 1 and 2 of the drawing, bowstring positioning shaft 6 of bowstring positioning device 5 may be mounted to bow 1 in any convenient manner. For example, the shaft may be threaded and fitted into a topped receptacle in bow 1. Alternatively, bowstring positioning shaft 6 may be fastened with a strong glue known to those skilled in the art, such as epoxy. Other techniques for fastening bowstring positioning shaft 6 on bow 1 which are known to those skilled in the art may be utilized as desired, so long as bowstring positioning device 5 is firmly mounted in a fixed position on bow 1 and in alignment with bowstring 2.

Figure 3:
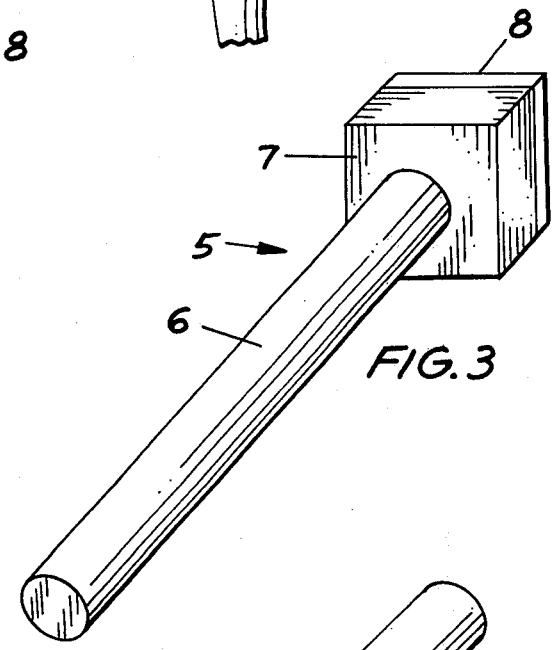
FIG. 3 is a perspective view of the bow positioning device detached from the bow.
Figure 4:
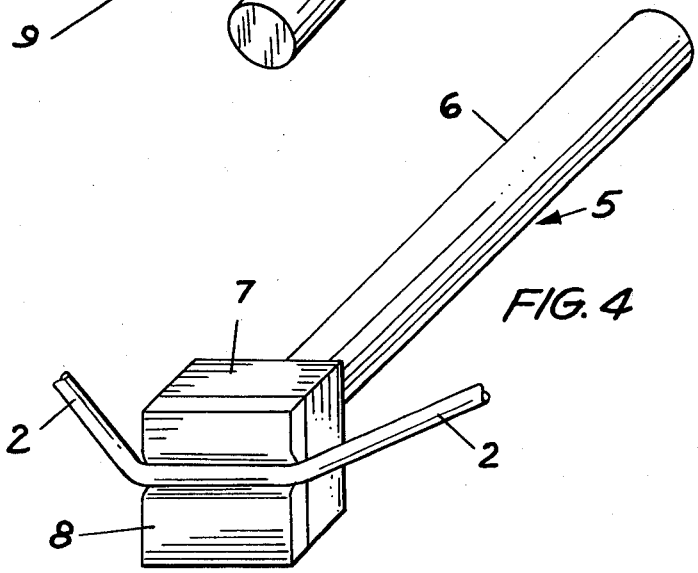
FIG. 4 is a perspective sectional view of the bow positioning device illustrated in FIG. 3, more particularly illustrating a typical bowstring position on the device.

Referring now to FIGS. 3 and 4 of the drawing, it will be appreciated that bowstring positioning shaft 6 carries bowstring positioning 7 at one end thereof. Bowstring positioning block 7 can also be attached to bowstring positioning shaft 6 in any convenient manner, such as by threading the shaft, tapping the block and joining the two members in this manner. Bowstring block pad 8 is secured to bowstring positioning block 7, as particularly illustrated in FIG. 4 in order to provide a pliable, resilient seat for bowstring 2. Accordingly, bowstring block pad 8 is preferably formed of a resilient material such as rubber or the equivalent. In addition to acting as an aid in the absorption of impact when the bowstring strikes bowstring positioning device 5, bowstring block pad 8 also serves to provide a secure seat for bowstring 2 and to minimize noise after an arrow is released. The device further enhances accuracy since it insures that arrows will always be released at the same point relative to the bow. This is not always true with respect to conventional bows since the arrow notch tolerances in each arrow may vary and therefore cause a varying resistance to release of each respective arrow from the bowstring. This resistance causes the bowstring to follow each arrow to a degree which is proportional to the bowstring-arrow notch resistance, and can cause the arrow to deflect from a true trajectory.

Lengthening and positioning bowstring 2 at a predetermined point away from bow 1 as illustrated in FIG. 1 of the drawing serves to permit a greater amount of energy to be imparted to the arrow than is possible where a shorter bowstring is positioned in the conventional fashion illustrated by reference numeral 3. For example, using the energy formula $E$ (energy) $= F$ (force) $\times d$ (distance), the energy of an arrow can be computed by multiplying the force exerted by the bowstring against the arrow by the distance through which the force operates to drive the arrow. Accordingly, if a conventional bow having a 50 pound pull at a full draw of 30 inches is used to drive an arrow, the energy imparted to the arrow would be $E = F/2 \times d$ (average force from 50 pounds to 0 pounds = 25 pounds). Accordingly, $E = 50/2 \times 30/12 = 62.5$ foot pounds.

Using the bowstring positioning device of this invention as illustrated in FIG. 1 of the drawing, assume a bowstring pull of 50 pounds at a draw of 24 inches and an initial force of 15 pounds at the poit where bowstring 2 contacts bowstring positioning device 5: $E = F \times d$; $E = (50+15/2) \times 25/12 = 32.5 \times 25/12 = 67.7$ foot pounds.

Accordingly, the energy available for driving arrows from a bow is greater under circumstances where the bowstring positioning device of this invention causes the bowstring to stop short of a zero force position.

Referring again to FIG. 1 of the drawing, it has also been found that lengthening bowstring 2 also aids in supplying additional energy to a released arrow, since the resultant of force along the arrow shaft is greater as the angle between the arrow shaft and the bowstring becomes more acute. Accordingly, the combined features of utilizing the bowstring positioning device 5 and a longer bowstring add significant power and accuracy to bow 1.

It will be appreciated as heretofore discussed, that the bowstring positioning device of this invention can be used on substantially all bows, including compound bows, in any situation where the distance between the bow and the bowstring can be extended beyond the characteristic straight line position of the bowstring between the ends of the bow. The device is particularly applicable to compound bows since the limbs of compound bows can be adjusted to provide a selected bowstring tension at the bowstring positioning device, and hence a selected energy to the arrow released at a given bowstring draw.

It will be further appreciated that the bowstring positioning device may be mounted essentially perpendicular to the bow, or at a slight angle, depending upon the design of the bow itself, a critical factor being alignment of the device and the bow and bowstring, in order to insure proper seating of the string after release, as heretofore noted.

Having described my invention with the particularity set forth above, what is claimed is:

1. A bowstring positioning device for a bow having a bowstring comprising a shaft having one end fixedly connected to said bow and extending in the direction of curvature and bend of said bow, and the opposite end positioned in alignment with the path of said bowstring and terminating at a point intermediate the normal, straight line position of said bowstring and the position of said bowstring when said bow is drawn, to receive and stop said bowstring when said bow is drawn and said bowstring is released.

2. The bowstring positioning device of claim 1 further comprising a bowstring position block on said opposite end of said shaft and a pad on said bowstring positioning block to receive and seat said bowstring after an arrow is released from said bow.

3. The bowstring positioning device of claim 1 wherein said shaft is positioned directly beneath the handgrip of said bow.

4. The bowstring positioning device of claim 1 further comprising a bowstring positioning block on said opposite end of said shaft and a pad on said bowstring positioning block to receive and seat said bowstring after an arrow is released from said bow, and wherein said shaft is positioned directly beneath the handgrip of said bow.

5. The bowstring positioning device of claim 1 wherein said bowstring is longer than a conventional bowstring for said bow.

6. The bowstring positioning device of claim 1 further comprising a bowstring positioning block on said opposite end of said shaft and a pad on said bowstring positioning block to receive and seat said bowstring after an arrow is released from said bow; and wherein:

a. said shaft is positioned directly beneath the handgrip of said bow; and b. said bowstring is longer than a conventional bowstring for said bow.

7. The bowstring positioning device of claim 6 wherein said pad is rubber.

* * * * *